US005803650A

United States Patent [19]

Wu

[11] Patent Number: 5,803,650

[45] Date of Patent: Sep. 8, 1998

[54] JOINT STRUCTURE OF COLLAPSIBLE PLAYPEN

[76] Inventor: Sung-Tsun Wu, 8F-1, No. 249, Chung-Ching Road, Panchiao, Taiwan

[21] Appl. No.: 794,954

[22] Filed: Feb. 4, 1997

[51] Int. Cl.[6] ..... A47D 7/00

[52] U.S. Cl. ..... 403/329; 403/102; 403/321; 5/99.1

[58] Field of Search ..... 403/102, 329, 403/321; 5/93.1, 98.3, 99.1

[56] References Cited

U.S. PATENT DOCUMENTS 5,367,725 11/1994 Tasi ..... 5/99.1

*Primary Examiner*—Anthony Knight

*Attorney, Agent, or Firm*—Pro-Techtor International Services

[57] ABSTRACT

A joint structure for releasably joining two bars of a playpen frame. A leaf spring with projections on its legs locks the frame in position. A user presses the projections to allow the frame to collapse. A releaser with movable flaps covers the joint body to protect the user's fingers from being pinched.

2 Claims, 4 Drawing Sheets

JOINT STRUCTURE OF COLLAPSIBLE PLAYPEN

FIELD OF THE INVENTION

The present invention relates generally to a collapsible playpen and in particular to a joint structure of the collapsible playpen.

BACKGROUND OF THE INVENTION

Playpens for keeping young babies therein to protect the babies from hurting themselves are known. Playpens with collapsible configuration are also known, which significantly reduces the space occupied by the playpen when the playpen is not in use. An example of the collapsible playpen is disclosed in U.S. Pat. No. 5,358,220 wherein the collapsible playpen comprises a rectangular top rail frame comprising four top rails pivoted at two opposite ends to a corner joint. Each of the corner joints has an upright leg fixed thereto. The lower end of each of the legs is pivotally connected to a central joint member by means of a diagonally extending reinforcement bar.

Each of the top rails comprises two bar members with a mid-joint pivotally connected therebetween so as to releasably secure the bar members in an expanded condition. The mid-joint comprises a release member to release the bar members from the expanded condition to a collapsed condition. Each of the bar member is secured in the expanded condition by means of two spring-biased retaining pins which extend into holes formed on the mid-joint. Thus, each of the mid-joints has four such retaining pins associated therewith. To simultaneously disengage the four retaining pins from the mid-joint, the release member is provided with four user-movable flaps each having an inward projection to engage and force the respective retaining pin to disengage from the mid-joint. The four flaps have to be depressed by the user's fingers at the same time in order to release the bar members from the expanded condition.

Such a releasing operation, to some extent, is not easy for a user has to use the thumb and index finger of two hands to simultaneously move the four tabs. A mistaken motion of any one of these fingers would render it unable to release the bar members from the expanded condition.

It is thus desired to provide an improvement over the prior art joint structure so as to make it easier to release the bar members from the mid-joint without sacrificing the capability of maintaining the bar members of the top rails in the expanded condition.

SUMMARY OF THE INVENTION

The principal object of the present invention is to provide a joint structure to be adapted in a collapsible playpen which allows a user to more readily release the collapsible playpen.

It is another object of the present invention to provide a joint structure of a collapsible playpen of the type discussed above which allows a user to release the joint with a single hand.

In accordance with the present invention, there is provided a joint structure of a collapsible playpen for releasably jointing two bar members, comprising a U-channel like joint body defined by two spaced side plates to receive therein an end of each of the bar members. The end of the bar member is pivoted to the joint body. The end of the bar member has a hollow section within which a U- or V-shaped leaf spring is received. The leaf spring has two legs each having a projection formed thereon and biased by the leaf spring to extend through a corresponding hole formed on the bar member. The projection is extendable through a hole formed on one of the side plates to retain the bar member in an expanded condition. The leg of the leaf spring has an end section outboard the projection and extending outside the hollow section of the bar member and into the joint body to be exposed through an opening formed on the joint body. A releaser having two movable flaps each corresponding to the respective opening of the joint body is fixed on the joint body so that by moving the flaps inward through the respective opening to depress the end section of the leaf spring, the respective leg of the leaf spring is forced inward to have the projection disengage from the hole of the joint body and thus releasing the bar member from the expanded condition.

BRIEF DESCRIPTION OF THE DRAWINGS

The present invention will be better understood from the following description of a preferred embodiment thereof, with reference to the attached drawings, wherein.

DETAILED DESCRIPTION OF THE PREFERRED EMBODIMENT

Figure 1:
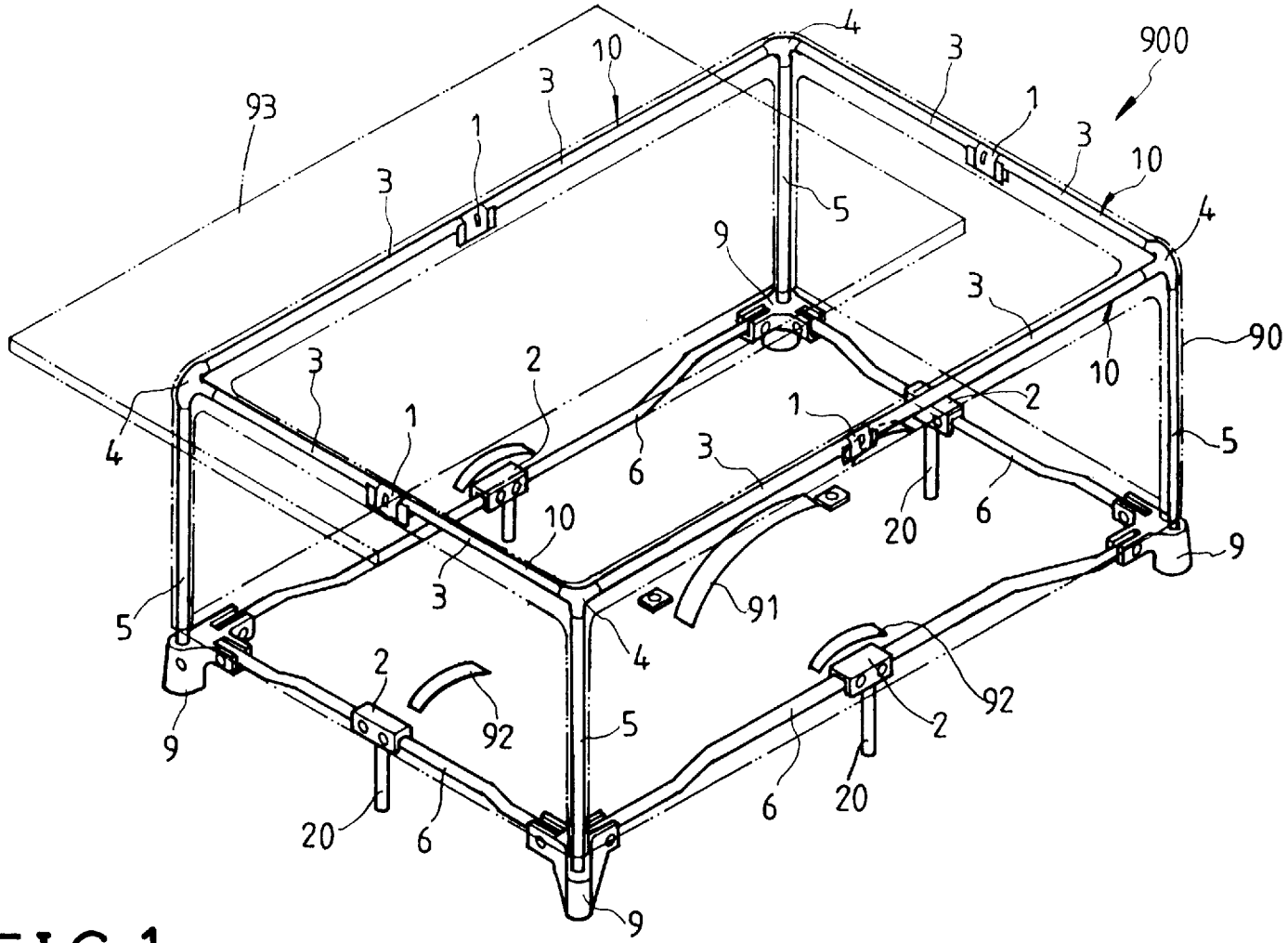
FIG. 1 is a perspective view showing a collapsible playpen in which a joint constructed in accordance with the present invention may be adapted.

With reference to the drawings and in particular to FIG. 1, which shows an example of collapsible playpen which is suitable to incorporate therein a joint structure in accordance with the present invention, the playpen, which is generally designated with reference numeral 900, comprises a top rail frame composed of four top rails 10 each having two ends pivotally connected to corner joints 4. Each of the corner joints 4 has an upright leg 5 extends downward therefrom to define a ground support member 9 to be positioned on the ground. A bottom bar 6 connects between every two adjacent ground support members 9 in a pivotal manner. Each of the bottom bars 6 may be composed of two segments pivoted to a central joint 2 which may also have a leg 20 extending therefrom to support on the ground.

A flexible covering member 90 may be attached to the playpen 900 as is commonly known. The covering member 90 may comprise hand grips 91 and 92 for user's hand to hold in operating the playpen 900. A bottom plate 93 may also be provided inside the playpen 900. These are all known and constitute no parts of the present invention.

Each of the top rails 10 is composed of two bars 3 with a joint 1 constructed in accordance with the present invention pivotally connected therebetween. The pivotal connection at the corner joints 4, the joints 1, the ground support members 9 and the central joint 2 allows the playpen 900 to be collapsed from an expanded condition to a collapsed condition wherein all the bars 3, the legs 5 and the bars 6 are located close to and substantially parallel with each other.

Such a collapsible playpen configuration is known and is not the major concern of the present invention. What is to be claimed and protected in the application is the structure of the joint 1 which will be described in the following paragraphs.

Figure 2:
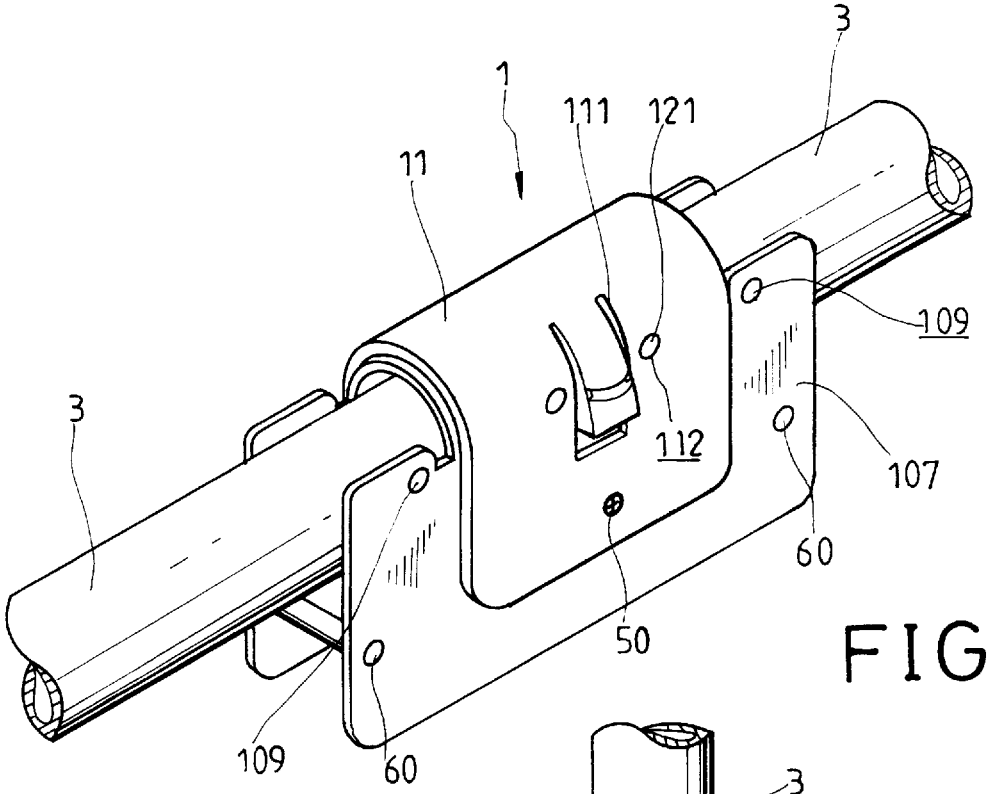
FIG. 2 is a perspective view showing the joint of the present invention in an expanded condition.
Figure 3:
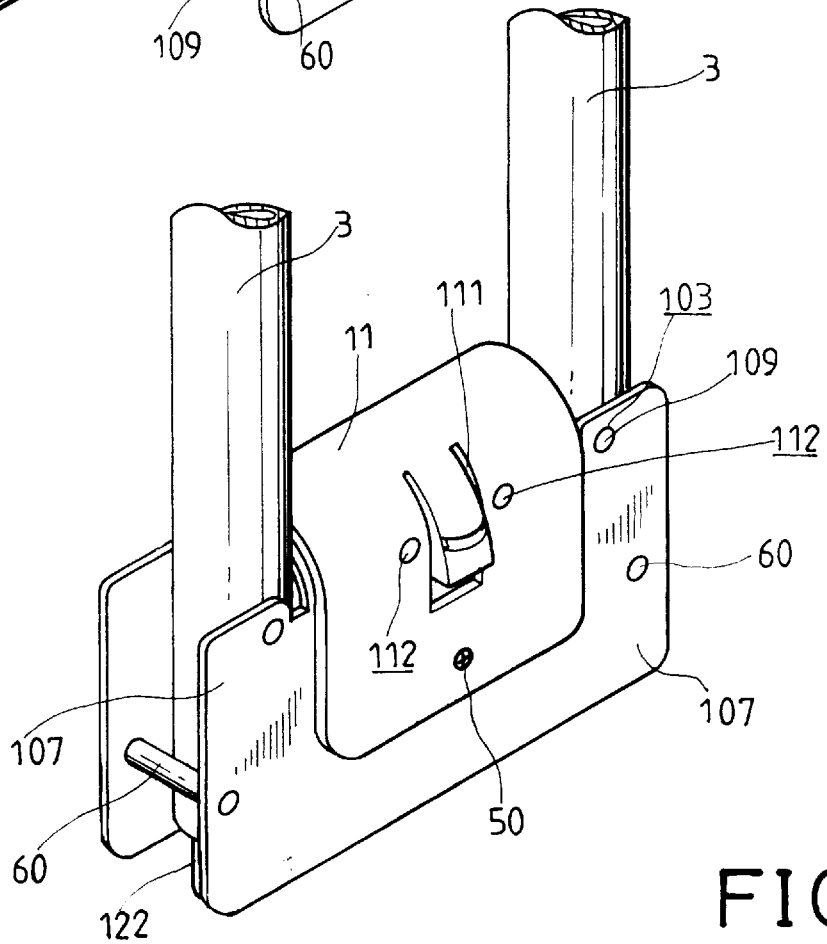
FIG. 3 is a perspective view showing the joint of the present invention in a collapsed condition.
Figure 4:
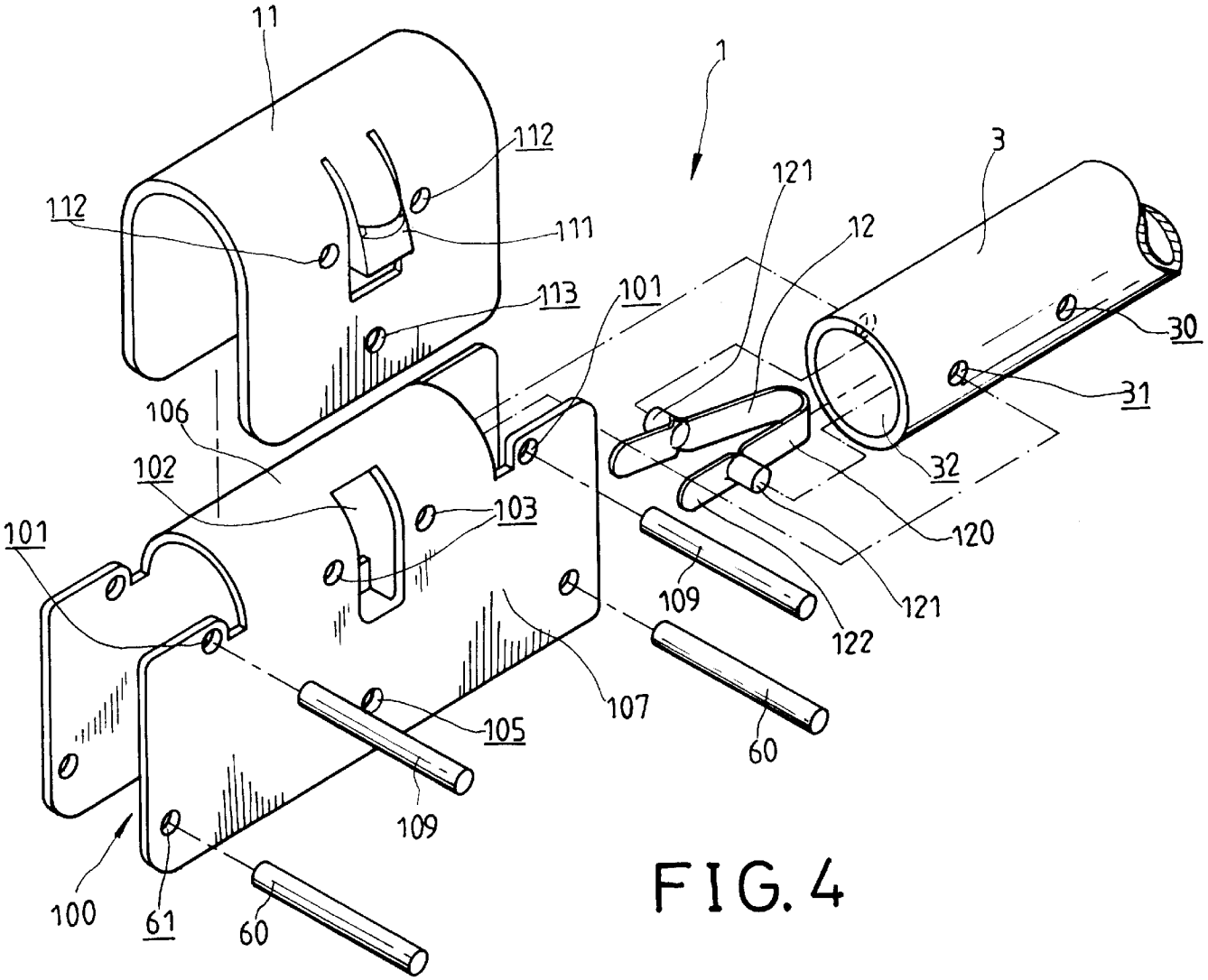
FIG. 4 is an exploded perspective view showing the joint of the present invention.

With particular reference to FIGS. 2–4, wherein the joint 1 in accordance with the present invention is shown, the joint 1 comprises a joint body 100 defined by two spaced plates 107 connected to each other with a saddle section 106, forming an inverted U-channel like configuration with a U-shaped cross section. Each of the side plates 107 comprises two end extensions beyond the saddle section 106 in two opposite directions to pivotally receive and fix an end of each of the bars 3 of the respective top rail 10 between the end extensions of the two side plates 108 by means of pivot pins 109 extending through holes 101 formed on the end extensions of the side plates 107 and corresponding holes 30 formed on the two bars 3. The holes 101 are located so that they are aligned with each other between the two side plates 108 and aligned with the corresponding hole 30 of the bar 3 for receiving the pivot pin 109 to extend therethrough.

It should be noted that in FIG. 4, only one of the two bars 3 of the top rail 10 is shown for simplicity.

Each of the bars 3 of the top rail 10 comprises a hollow end 32 within which resilient means, such as a U- or V-shaped leaf spring 12, is received and retained. The leaf spring 12 has two spaced legs 120 having a first end connected to each other to define the U or V shape and an opposite free end. Each of the legs 120 has a sideways projection 121 formed thereon inboard the free end of the leg 120 so as to define an end section 122 at the free end thereof.

The projections 56 of the resilient means 12 extend substantially in opposite directions and partially project out of the bar 3 through two holes 31 formed on the bar 3 by being biased by the leaf spring 12. Corresponding to the two holes 31, the side plates 107 of the joint body 100 are each provided with holes 103 into which the projections 121 that partially project out of the holes 31 of the bar 3 are received. The holes 103 are located so that when the projections 121 are received therein (see FIG. 5), the bar 3 of the top rail 10 is in the expanded condition where the two bars 3 that are connected to the joint 1 are substantially aligned with each other, as shown in FIG. 2.

A releaser 11 is provided to release the bars 3 from the expanded condition shown in FIG. 2 and to allow the bars 3 of the top rail 10 to be rotated relative to the joint body 100 and thus folded into the collapsed condition shown in FIG. 3. The releaser 11 is a substantially U-shaped member to be fit over the saddle section 106 of the joint body 100. The releaser 11 comprises two movable tabs 111 which are manually deformable from two opposite directions so as to be moveable into two openings 102 formed on the joint body 40. The leaf spring 12 is so sized that the two free end sections 122 of the legs 120 thereof are extending out of the bars 3 and located at such positions within the joint body 100 to be exposed through the openings 102 of the joint body 100 and thus contactable by the tabs 111 of the releaser 11 when the tabs 111 are depressed (see FIG. 6) so that the manual deformation of the tabs 111 of the releaser 11 forces the free end sections 122 of the leaf spring 12 inward to disengage the projections 121 from the holes 103 of the joint body 100 and thus allowing the bars 3 to rotate relative to the joint body 100. This releases the bars 3 of the top rail 10 from the expanded condition.

The releaser 11 may be secured to the joint body 100 by means of a bolt 50, see FIGS. 2 and 3, which extends through holes 113 formed on the releaser 11 and corresponding holes 105 formed on the joint body 100.

The releaser 11 is also provided with holes 112 that are substantially aligned with the holes 103 of the joint body 100 to partially receive the projections 121 therein when the bars 3 are in the expanded condition.

The joint 1 is also provided with stops 60 which are in the form of pins in the embodiment illustrated to stop the bars 3 at predetermined collapsed positions in collapsing the playpen 900. The stop pins 60 extend through and are retained in holes 61 formed on the side plates 107 of the joint body 100 and the holes 61 are located so that when the bars 3 reach the predetermined collapsed positions, as shown in FIG. 3, the bars 3 are brought into contact with the stop pins 60 so as to stop the movement of the bars 3 at the collapsed condition shown in FIG. 3.

Figure 5:
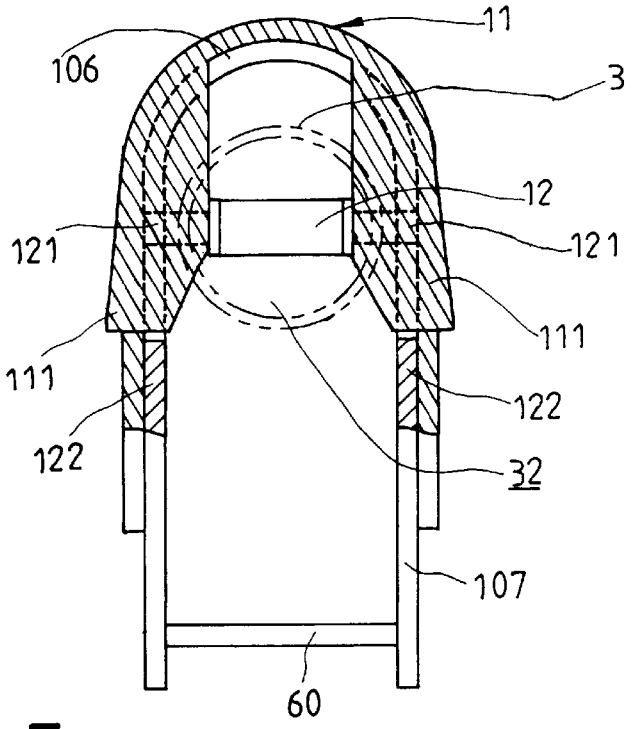
FIGS. 5 and 6 are sectional views showing the operation of releasing the joint of the present invention.
Figure 6:
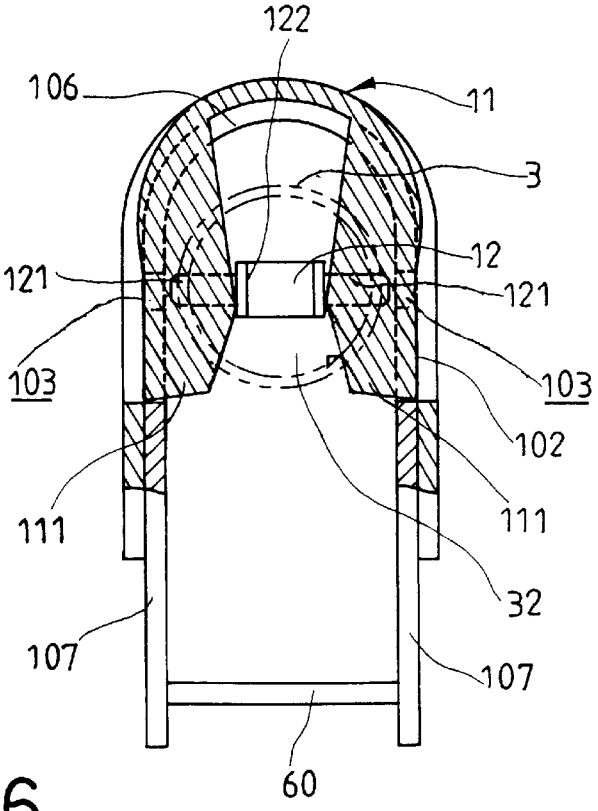

FIGS. 5 and 6 respectively show the relationship between the tabs 111 of the releaser 11 and the projections 121 of the leaf spring 12 in the expanded condition and the collapsed condition and also illustrate the projections 121 of the leaf spring 12 and the holes 103 of the joint body 100 in the expanded condition and the collapsed condition.

It is apparent from the above description that the arrangement and configuration of the leaf spring 12, together with the openings 102 of the joint body 100 and the movable tabs 111 of the releaser 11, allow the joint 1 to be released with a single hand by using the thumb and the index finger to depress the tabs 111 inward and disengage the projections 121 of the leaf spring 12 from the joint body 100. As compared with the conventional design which needs two hands to perform the releasing operation, the present invention offers a simple and ready to operate structure of the joint.

Although a preferred embodiment has been described to illustrate the present invention, it is apparent that changes and modifications in the specifically described embodiment can be carried out without departing from the scope of the invention which is intended to be limited only by the appended claims.

What is claimed is:

1. In a collapsible playpen comprising a top rail frame comprising four rails each having two bars pivotally connected to a joint located therebetween, the joint comprising:

a U-channel like joint body comprising two spaced side plates connected to each other with a saddle section, each of the side plates having two end extensions in opposite directions to receive an end of each of the bars, a pin being provided to pivot the bar to the joint body to allow the bars to rotate between an expanded position and a collapsed position, the joint body comprising an opening on each of the side plates, the opening being larger than a hole formed on each side plate;

a U-shaped leaf spring received and retained within a hollow section of each of the bars, comprising two spaced legs each having a sideways projection received within and extendable through a hole formed on the bar to be receivable within the hole formed on the respective side plate to maintain the bar in the expanded position, each of the legs having a free end section extending out of the bar to be located within the joint body to be exposed through the opening of the joint body; and a releaser attached to the joint body, comprising two movable tabs corresponding in position to the openings of the joint body to be movable into the openings to contact at a position distal to the projections of the legs of the leaf springs and depress the legs of the leaf spring inward so as to disengage the projections of the leaf spring from the holes formed on the side plates of the joint body and thus releasing the bars from the expanded position.

2. The joint as claimed in claim 1, wherein the joint body comprises a stop pin extending between the two side plates to stop the rotation of each of the bars relative to the joint body at the collapsed position.

* * * * *